US012629747B2

(12) United States Patent
Baumgartner et al.

(10) Patent No.: US 12,629,747 B2
(45) Date of Patent: May 19, 2026

(54) METHOD FOR PRODUCING A DUAL-PHASE STEEL STRIP IN A COMBINED CASTING AND ROLLING SYSTEM, A DUAL-PHASE STEEL STRIP PRODUCED BY MEANS OF THE METHOD, AND A COMBINED CASTING AND ROLLING SYSTEM

(71) Applicant: Primetals Technologies Austria GmbH, Linz (AT)

(72) Inventors: Kerstin Baumgartner, Katsdorf (AT); Heinz Fürst, Gallneukirchen (AT); Simon Grosseiber, Leonding (AT); Thomas Lengauer, Weißkirchen a.d. Traun (AT); Gero Schwarz, Attnang-Puchheim (AT)

(73) Assignee: Primetals Technologies Austria GmbH (AT)

( * ) Notice: Subject to any disclaimer, the term of this patent is extended or adjusted under 35 U.S.C. 154(b) by 0 days.

(21) Appl. No.: 18/705,987

(22) PCT Filed: Oct. 19, 2022

(86) PCT No.: PCT/EP2022/079003
§ 371 (c)(1),
(2) Date: Apr. 29, 2024

(87) PCT Pub. No.: WO2023/072686
PCT Pub. Date: May 4, 2023

(65) Prior Publication Data

US 2025/0010360 A1 Jan. 9, 2025

(30) Foreign Application Priority Data

Oct. 29, 2021 (AT) ..... A50855/2021

(51) Int. Cl.
*C21D 8/02* (2026.01)
*B21B 3/02* (2006.01)
(Continued)

(52) U.S. Cl.
CPC ..... *B22D 11/124* (2013.01); *B21B 3/02* (2013.01); *B22D 11/001* (2013.01); *B22D 11/14* (2013.01);
(Continued)

(58) Field of Classification Search
None
See application file for complete search history.

(56) References Cited

U.S. PATENT DOCUMENTS 5,042,564 A 8/1991 Van Perlstein et al.
6,773,522 B1 8/2004 Bodin et al.
(Continued)

FOREIGN PATENT DOCUMENTS

CN 112024595 A * 12/2020 ..... B21B 1/26
DE 19911287 C1 8/2000
(Continued)

OTHER PUBLICATIONS

Machine translation of CN 112024595A. (Year: 2020).*
International Search Report mailed Feb. 3, 2023 in corresponding PCT International Application No. PCT/EP2022/079003.

*Primary Examiner* — Xiaowei Su
(74) *Attorney, Agent, or Firm* — OSTROLENK FABER LLP

(57) ABSTRACT

A method for producing a dual-phase steel strip in a system having a finish-rolling train with a first stand group that includes at least one first finish-rolling stand, and a second stand group that includes at least one stand cooler. The system has a cooling section that includes a first cooling section group and a second cooling section group. Immedi-
(Continued)

ately following finish-rolling of a finish-rolled strip, the finish-rolled strip is fed to the second stand group, and force-cooled to a second exit temperature (TA2) so that upon exiting the second stand group the strip has a predominantly austenitic structure. Once the force-cooling stops, a ferritic and austenitic structure forms in the finish-rolled strip during transport. The finish-rolled strip is force-cooled to a fourth exit temperature (TA4) in the second cooling section group so that, upon exiting, the finish-rolled strip has a dual-phase structure composed of martensite and ferrite.

14 Claims, 3 Drawing Sheets

(51) Int. Cl.

| | |
|---|---|
| ***B22D 11/00*** | (2006.01) |
| ***B22D 11/124*** | (2006.01) |
| ***B22D 11/14*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.
CPC ..... *C22C 38/002* (2013.01); *C22C 38/02* (2013.01); *C22C 38/04* (2013.01); *C22C 38/22* (2013.01); *C22C 38/26* (2013.01); *C22C 38/28* (2013.01); *C22C 38/38* (2013.01)

(56) References Cited

U.S. PATENT DOCUMENTS

| | | | | |
|---|---|---|---|---|
| 6,855,218 | B1 | 2/2005 | Kawalla et al. | |
| 8,087,449 | B2 | 1/2012 | Benedetti et al. | |
| 9,458,521 | B2 | 10/2016 | Nakagaito et al. | |
| 11,198,929 | B2 | 12/2021 | Toyoda et al. | |
| 2009/0214377 | A1 | 8/2009 | Hennig et al. | |
| 2016/0151814 | A1* | 6/2016 | Fischer ..... | C21D 8/0226 72/201 |
| 2016/0288181 | A1 | 10/2016 | Weinzierl | |
| 2019/0085427 | A1 | 3/2019 | Takashima et al. | |

FOREIGN PATENT DOCUMENTS

| | | | |
|---|---|---|---|
| DE | 102005051052 | A1 | 4/2007 |
| DE | 202011110913 | U1 | 4/2017 |
| EP | 0370575 | A1 | 5/1990 |
| EP | 0750049 | A1 | 12/1996 |
| EP | 1662011 | A1 | 5/2006 |
| EP | 2202327 | A1 | 6/2010 |
| EP | 2873469 | A1 | 5/2015 |
| EP | 3705593 | A1 | 9/2020 |
| WO | WO 9929444 | A1 | 6/1999 |

* cited by examiner

METHOD FOR PRODUCING A DUAL-PHASE STEEL STRIP IN A COMBINED CASTING AND ROLLING SYSTEM, A DUAL-PHASE STEEL STRIP PRODUCED BY MEANS OF THE METHOD, AND A COMBINED CASTING AND ROLLING SYSTEM

CROSS-REFERENCE TO RELATED APPLICATIONS

The present application is a 35 U.S.C. §§ 371 national stage application of International Application No. PCT/EP2022/079003, filed Oct. 19, 2022, which claims priority to Austrian Patent Application No. A50855/2021, filed Oct. 29, 2021, the contents of which are incorporated herein by reference.

FIELD OF INVENTION

The invention relates to a method for producing a dual-phase steel strip, to a dual-phase steel strip, and to a combined casting and rolling plant for producing the dual-phase steel strip.

BACKGROUND

WO 2019/020492 A1 discloses a roll stand having a stand cooler for cooling a steel strip. Moreover, WO 2020/126473 A1 discloses cooling of a metal strip in a roll stand.

SUMMARY OF THE INVENTION

An object of the invention is to provide an improved method for producing a dual-phase steel strip by means of a combined casting and rolling plant, a dual-phase steel strip and an improved combined casting and rolling plant.

This object is achieved by a method as claimed by a dual-phase steel strip as claimed and by a combined casting and rolling plant as claimed. Advantageous embodiments are specified in the dependent claims.

It has been found that an improved method for producing a dual-phase steel strip by means of a combined casting and rolling plant can be provided in that the combined casting and rolling plant has a finish-rolling train and a cooling section. The finish-rolling train has a first stand group having at least one first finish-rolling train and a second stand group having at least one stand cooler. The cooling section has a first cooling-section group and a second cooling-section group. A hot prerolled strip is fed to the first stand group of the finish-rolling train, and the first stand group of the finish-rolling train finish-rolls the hot prerolled strip to afford a finish-rolled strip. Directly after the finish-rolling of the finish-rolled strip, the finish-rolled strip is fed to the second stand group and, in the second stand group, the finish-rolled strip is force-cooled to a second outlet temperature while maintaining a thickness of the finish-rolled strip, in such a way that the finish-rolled strip has a predominantly (greater than 80 percent by weight) austenitic microstructure when it leaves the second stand group. The finish-rolled strip, which has been cooled to the second outlet temperature, is fed to the first cooling-section group. Forced cooling of the finish-rolled strip in the first cooling-section group is deactivated and the finish-rolled strip is transported in the first cooling-section group to the second cooling-section group. During the transport, a ferritic and austenitic microstructure predominantly forms in the finish-rolled strip. In the second cooling-section group, the finish-rolled strip is force-cooled to a fourth outlet temperature in such a way that, after leaving the second cooling-section group, the finish-rolled strip has a dual-phase microstructure of martensite and ferrite.

In this document, force-cooled should be understood to mean the active cooling of the steel strip, for example by spraying it with a liquid coolant (usually water). The forced cooling takes place under pressure (cf. what is referred to as Power Cooling) or at ambient pressure (cf. what is referred to as laminar cooling). In contrast to this is the passive cooling of the steel strip by pure convection, or pure radiation. A forced cooling means is an apparatus for active cooling of a steel strip.

The method has the advantage that a particularly thin dual-phase steel strip having a particularly high quality can be produced, and at the same time the conversion outlay of the combined casting and rolling plant for performing the method is kept particularly low.

In another embodiment, the finish-rolled strip is force-cooled in the second stand group in such a way that a first cooling rate of a core of the finish-rolled strip is established. While the finish-rolled strip is being transported between the second stand group of the finish-rolling train and the second cooling-section group, a second cooling rate of the core of the finish-rolled strip is established. In the second cooling-section group, the finish-rolled strip is force-cooled in such a way that a third cooling rate of the core of the finish-rolled strip is established. The second cooling rate is lower than the first cooling rate and/or the third cooling rate. The first cooling rate and/or the third cooling rate of the core of the finish-rolled strip is preferably 100 K/s to 2000 K/s inclusive, in particular 200 K/s to 1000 K/s inclusive. The third cooling rate of the core of the finish-rolled strip is 0 K/s to 20 K/s inclusive. This configuration has the advantage that the first high cooling rate leads to rapid cooling into the (partially) ferritic range. This in turn promotes the rapid formation of homogeneous ferritic grains from the austenitic structure. The low second cooling rate gives the microstructure enough time to convert the desired microstructure proportion (50%-95%) from austenite to ferrite at the established temperature. The total time for which the second cooling rate prevails is also referred to as holding time. The third cooling rate is necessary to avoid a preferably complete conversion of austenite to ferrite. Instead, by virtue of the high third cooling rate, the remaining austenite proportion is converted to a martensitic microstructure. Ultimately, at room temperature, a microstructure comprising ferrite (50 to 95 percent by weight) and martensite (10 percent by weight to 50 percent by weight) is present. Moreover, there may also be less than or equal to 5 percent by weight of residual austenite and/or bainite. In other words, at room temperature, the end product may contain up to and including 5 percent by weight of residual austenite and bainite, or total residual austenite and bainite. The microstructure is referred to as dual-phase microstructure and the end product is referred to as dual-phase steel.

In another embodiment, a third surface temperature, with which the finish-rolled strip leaves the second stand group, is ascertained between the second stand group and the cooling section. The forced cooling in the second stand group is controlled depending on the third surface temperature and a third target temperature in such a way that the third surface temperature corresponds substantially to the third target temperature. The third target temperature is lower than an austenite-ferrite conversion temperature (Ar3 temperature). This configuration has the advantage that it is possible to produce a particularly inexpensive dual-phase steel strip which has high mechanical quality and particularly few microalloy elements.

In another embodiment, a second surface temperature, with which the finish-rolled strip leaves the first stand group, is ascertained, the second surface temperature also being taken into account in the control of the forced cooling of the finish-rolled strip in the second stand group. This configuration has the advantage that the first cooling rate of the core of the finish-rolled strip can be particularly precisely controlled in open-loop or closed-loop fashion by means of the forced cooling in the first stand group.

In another embodiment, a core of the finish-rolled strip is transported into the second stand group of the finish-rolling train with a first outlet temperature of 830° C. to 950° C., in particular 850° C. to 920° C. When the finish-rolled strip leaves the second stand group, the core of the finish-rolled strip has the second outlet temperature of in particular 600° C. to 750° C., preferably 650° C. to 720° C. This ensures that, as it leaves the second stand group, the finish-rolled strip cooled for the first time has the second outlet temperature, which is below the austenite-ferrite conversion temperature (Ar3 temperature).

In another embodiment, the core of the finish-rolled strip is cooled, preferably continuously, from the first outlet temperature to the second outlet temperature within a first time interval of 0.2 seconds to 1 second.

In another embodiment, the finish-rolled strip is transported from the second stand group of the finish-rolling train to the second cooling-section group via the first cooling-section group within a second time interval of 3 seconds to 6 seconds, in particular 4 seconds to 5 seconds. This configuration ensures that the finish-rolled strip is given enough holding time to be able to convert a sufficiently large proportion of austenitic microstructure to ferritic microstructure within the second time interval during the transport section, in which the finish-rolled strip is not actively force-cooled, with the result that there is a dual-phase microstructure of ferrite and austenite in the finish-rolled strip at the end of the second time interval.

In another embodiment, the core of the finish-rolled strip is transported to the second cooling-section group of the cooling section with a third outlet temperature of 580° C. to 650° C., in particular 590° C. to 630° C. When the finish-rolled strip leaves the second cooling-section group, the core of the finish-rolled strip has the fourth outlet temperature of in particular 150° C. to 250° C., preferably 190° C. to 230° C. This configuration ensures that, after the cooling, the finish-rolled strip is fully produced in the form of a dual-phase steel strip having the austenitic and martensitic microstructure. The temperature of 150° C. to 200° C., preferably 190° C. to 230° C., ensures that remaining cooling medium, in particular cooling water, can run off of or evaporate from the finish-rolled strip as the finish-rolled strip is being transported further on in the uncoiled state toward a coiling device, with the result that the finish-rolled strip in the form of a dual-phase steel strip can be coiled up to form a coil. In particular, this avoids corrosion of the dual-phase steel strip in the coiled state on the coil.

In another embodiment, the core of the finish-rolled strip is cooled, preferably continuously, from the third outlet temperature to the fourth outlet temperature within a third time interval of 0.2 seconds to 1 second. The rapid cooling ensures the high third cooling rate and ensures a substantially complete transition of the austenitic microstructure into martensite.

In another embodiment, a thickness of the prerolled strip when it enters the first stand group is 6 mm to 25 mm, in particular 8 mm to 10 mm. The first stand group reduces the thickness of the prerolled strip to that of the finish-rolled strip of 0.7 mm to 2.0 mm, in particular 0.7 mm to 1.3 mm. This makes it possible to ensure a particularly thin dual-phase steel strip, which is suitable in particular for producing motor vehicle bodies, at the end of the method.

In another embodiment, the finish-rolled strip has a chemical composition in percent by weight of C 0.03-0.30%; Mn 1.0-2.0%; Si 0.1-1.0%; sum total of the alloy constituents Cr and Mo [abbreviated as the sum total of (Cr+Mo)]: 0.2-1.0%; sum total of the alloy constituents Nb and Ti [abbreviated as the total of (Nb+Ti)]: 0.02-0.1%; P 0-0.02; remainder Fe and unavoidable impurities.

In another embodiment, the second stand group has a second finish-rolling stand, wherein the second finish-rolling stand, in a preparation step prior to casting of the molten metal, is converted to the stand cooler by removing at least one working roller of the second finish-rolling stand and introducing at least one cooling beam into the second finish-rolling stand. This makes it possible to convert the combined casting and rolling plant particularly easily.

An particularly good dual-phase steel strip, preferably having a thickness of 0.7 mm to 2.0 mm, in particular 0.7 mm to 1.3 mm, can be produced by the method described above. The dual-phase steel strip has a chemical composition in percent by weight of C 0.03-0.30%; Mn 1.0-2.0%; Si 0.1-1.0%; sum total of the alloy constituents Cr and Mo: 0.2-1.0%; sum total of the alloy constituents Nb and Ti: 0.02-0.1%; P 0-0.02; remainder Fe and unavoidable impurities. In this context, at room temperature, the finish-rolled strip has the following microstructure (based on percent by weight): 50% to 95% inclusive of ferrite, 10% to 50% inclusive of martensite, less than or equal to 5% of residual austenite and/or bainite, and, if appropriate, a remainder. The dual-phase steel strip preferably has a thickness of 0.7 mm to 2.0 mm, in particular 0.7 mm to 1.3 mm. In particular, the dual-phase steel strip is thinner than 1.4 mm.

An improved combined casting and rolling plant for producing a dual-phase steel strip, preferably having a thickness of 0.7 mm to 2.0 mm, in particular 0.7 mm to 1.3 mm, by the method described above comprises at least one finish-rolling train having at least a first stand group and a second stand group. The finish-rolling train also has a cooling section with a first cooling-section group and a second cooling-section group, wherein a prerolled strip can be fed to the finish-rolling train and the first stand group is designed to finish roll the prerolled strip to afford a finish-rolled strip. Based on a conveying direction of the finish-rolled strip, the second stand group is downstream of the first stand group and has at least one stand cooler. The second stand group is designed to force cool the finish-rolled strip to a second outlet temperature while maintaining a thickness of the finish-rolled strip. Based on the conveying direction of the finish-rolled strip, the first cooling-section group is downstream of the second stand group.

Forced cooling of the finish-rolled strip in the first cooling-section group is deactivated. Based on the conveying direction of the finish-rolled strip, the second cooling-section group is downstream of the first cooling-section group, wherein the second cooling-section group is designed to force-cool the finish-rolled strip to a fourth outlet temperature. This configuration has the advantage that a dual-phase steel strip of low thickness can be produced on a conventional combined casting and rolling plant with low outlay, and only the second finish-rolling stand of the plant needs to be converted to a stand cooler. This makes it possible to produce a particularly high-quality dual-phase steel strip by means of a conventional combined casting and rolling plant. In another operating state, the second finish-rolling train may again be provided with rollers, in order for example to produce a thicker steel strip, for example having a thickness of greater than 1.5 mm, with a substantially uniform phase. The greater thickness of the finish-rolled strip produced during normal operation in the further operating state means that the full length of the cooling section is required to cool the finish-rolled strip to the fourth outlet temperature, with the result that the first cooling-section group is then also activated to cool the finish-rolled strip during normal operation.

BRIEF DESCRIPTION OF THE FIGURES

In another embodiment, a measuring section is arranged between the cooling section and the second finish-rolling train. The measuring section has at least one sensor device, which is designed at least to detect a third surface temperature of the finish-rolled strip. The measuring section also has a roller conveyor, which is designed to transport the finish-rolled strip from the second finish-rolling train to the first cooling-section group. This configuration has the advantage that the measuring section is also used to ensure the holding time, wherein the second outlet temperature is substantially maintained, or the finish-rolled strip is slightly cooled at the second cooling rate, in the second time interval and this enables a high degree of conversion of some of the austenitic microstructure to ferritic microstructure. The conjoint use of the measuring section makes it possible to keep an overall length of the combined casting and rolling plant particularly short.

The invention is elucidated in more detail below with reference to figures, in which:

FIG. 7 schematically shows the detail A marked in FIG. 1 of the combined casting and rolling plant while the method described in FIG. 5 is being performed.

FIG. 1 shows a schematic representation of a combined casting and rolling plant 10.

DETAILED DESCRIPTION

Figure 1:
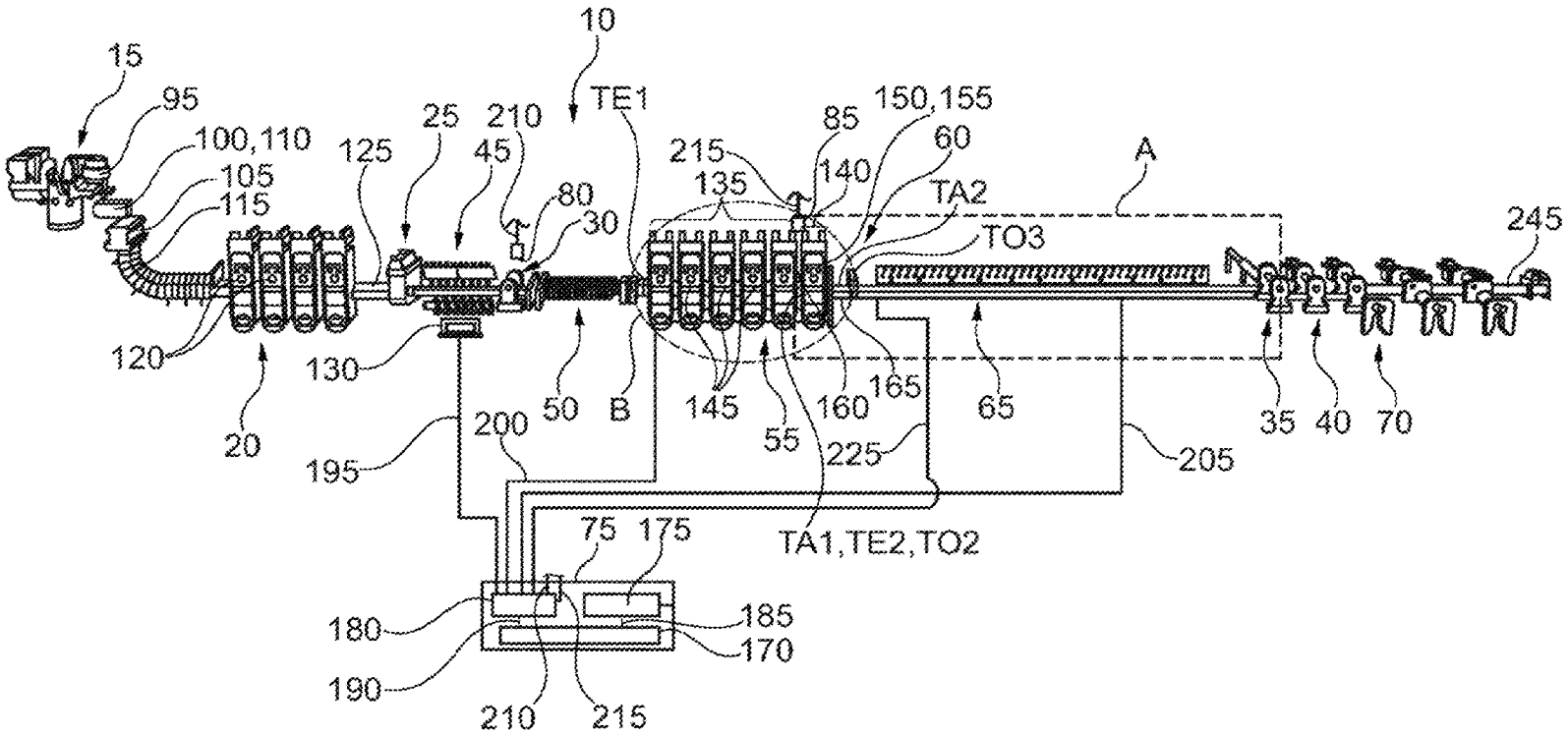
FIG. 1 shows a schematic representation of a combined casting and rolling plant.

The combined casting and rolling plant 10 has, for example, a continuous casting machine 15, a prerolling train 20, preferably a first to fourth separating device 25, 30, 35, 40, an intermediate heater 45, preferably a descaler 50, a finish-rolling train 55, a measuring section 60, a cooling section 65, at least one coiling device 70 and a control unit 75. In addition, the combined casting and rolling plant 10 may have at least a first to second temperature measuring device 80, 85, for example a pyrometer in each case.

By way of example, the continuous casting machine 15 is in the form of a bow-type continuous casting machine. A different configuration of the continuous casting machine 15 would also be conceivable. The continuous casting machine 15 has a ladle 95, a distributor 100 and a mold 105. During operation of the combined casting and rolling plant 10, the distributor 100 is filled with a molten metal 110 using the ladle 95. The molten metal 110 can be produced, for example, by means of a converter, for example in a Linz-Donawitz method. The molten metal 110 may comprise, for example, steel. From the distributor 100, the molten metal 110 flows into the mold 105. In the mold 105, the molten metal 110 is cast to afford a thin-slab strand 115. The partially solidified thin-slab strand 115 is drawn out of the mold 105 and deflected, by way of example, in an arc into a horizontal, while being supported and solidified, by virtue of the continuous casting machine 15 being in the form of a bow-type continuous casting machine. The thin-slab strand 115 is conveyed away from the mold 105 in the conveying direction.

It is especially advantageous here if the continuous casting machine 15 casts the thin-slab strand 115 as a continuous strand. The prerolling train 20 is downstream of the continuous casting machine 15 in a conveying direction of the thin-slab strand 115. In this embodiment, the prerolling train 20 follows on directly from the continuous casting machine 15.

The prerolling train 20 may have one or more prerolling stands 120 arranged one after the other in the conveying direction of the thin-slab strand 115. The number of prerolling stands 120 can substantially be selected freely and substantially depends on a format of the thin-slab strand 115. A desired thickness of a prerolled strip 125 rolled by the prerolling stands 120 is also important in this respect. In this embodiment, by way of example four prerolling stands 120 are provided for the prerolling train 20 shown in FIG. 1. The prerolling train 20 is designed to roll the thin-slab strand 115, which is hot when fed into the prerolling train 20, to afford the prerolled strip 125.

In this embodiment, by way of example the first and the second separating device 25, 30 are downstream of the prerolling train 20 based on the conveying direction of the prerolled strip 125.

The second separating device 30 is spaced apart from the prerolling train 20, based on the conveying direction of the prerolled strip 125. A discharging device 130 may be arranged between the first separating device 25 and the second separating device 30 in order to discharge a thin-slab piece separated by the first and the second separating means 25, 30. It is also possible to dispense with the second separating device 30. The first and the second separating device 25, 30 may for example be in the form of drum shears or pendulum shears.

Based on the conveying direction of the prerolled strip 125, in this embodiment, the second separating device 30 is followed by the intermediate heater 45 by way of example. By way of example, the intermediate heater 45 is in the form of an induction furnace. A different configuration of the intermediate heater 45 would also be possible. The intermediate heater 45 is upstream of the finish-rolling train 55 and the descaler 50 based on the conveying direction of the prerolled strip 125. The descaler 50 is directly upstream of the finish-rolling train 55 and downstream of the intermediate heater 45. The descaler 55 may also be omitted.

The finish-rolling train 55, in this embodiment, has a first stand group 135 and a second stand group 140. The first stand group 135 is upstream of the second stand group 140 based on the conveying direction of the prerolled strip 125. The first stand group 135 may have, for example, three to five first finish-rolling stands 145. The first finish-rolling stands 145 are arranged one behind another based on the conveying direction of the prerolled strip 125. In this case, by way of example, the first stand group 135 follows directly on from the descaler 50, if the descaler 50 is provided, based on the conveying direction of the prerolled strip 125. If the descaler 50 is dispensed with, the first stand group 135 follows directly on from the intermediate heater 45.

In this embodiment, the second stand group 140 has, for example, a second finish-rolling train 150. A different number of second finish-rolling trains 150 would also be possible. The first finish-rolling train 145 and the second finish-rolling train 150 are substantially identical, by way of example. In this embodiment, by way of example, the second finish-rolling stand 150 has a means for possible conversion to a stand cooler 155. In this embodiment, in terms of the function of the stand cooler 155, the second finish-rolling stand 150 no longer performs a rolling process.

In addition, the second stand group 140 may have an intermediate cooler 160. In this embodiment, the intermediate cooler 160 is arranged, by way of example, between the first finish-rolling stand 145, which is the last one in the conveying direction, of the first stand group 135 and the second finish-rolling stand 150. The intermediate cooler 160 may also be omitted.

During operation of the combined casting and rolling plant 10, the first finish-rolling stands 145 finish-roll the prerolled strip 125 fed into the first stand group 135 to afford a finish-rolled strip 165.

As already elucidated above, in this embodiment, the second finish-rolling stand 150 has been converted to the stand cooler 155. The possible means of conversion may be implemented in that the second finish-rolling stand 150 has a changeover device (not illustrated). In one configuration of the second finish-rolling stand 150 as second rolling stand, the changeover device secures at least one insert and an upper and/or lower working roller 156, 157 (illustrated in FIG. 3) in the second finish-rolling stand 150. In the configuration as second finish-rolling stand 150 with at least the upper and/or lower working roller 156, 157, the second finish-rolling stand 150 is designed to roll the prerolled strip 125.

In the configuration of the second finish-rolling stand 150 as stand cooler 155, the changeover device secures means for cooling a finish-rolled strip 165 rather than the insert and the lower and/or upper working rollers 156, 157. The insert and the upper and/or lower working rollers 156, 157 have been removed.

The configuration of the second finish-rolling stand 150 as stand cooler 155 and the intended means for cooling the finish-rolled strip 165 are discussed below. The changeover device allows the second finish-rolling stand 150 to be converted rapidly and easily between the second rolling stand 150 for rolling the prerolled strip 125 and the stand cooler 155.

Figure 4:
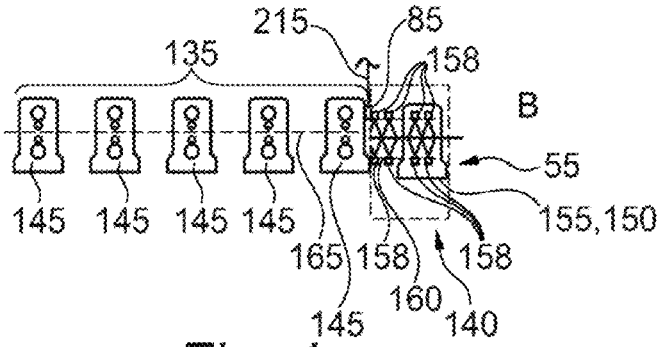
FIG. 4 shows the finish-rolling train shown in FIG. 1 in the converted state.

The stand cooler 155 and the intermediate cooler 160 each have, as means for cooling, at least one cooling beam 158, preferably an arrangement of cooling beams 158 (indicated schematically in FIG. 4). The cooling beams 158 of the stand cooler 155 and/or of the intermediate cooler 160 are preferably respectively arranged both on the top side and on the bottom side relative to the finish-rolled strip 165, in order to particularly rapidly and effectively cool the finish-rolled strip 165 on both sides. In the stand cooler 155, the cooling beam 158 is secured by means of the changeover device rather than the upper and/or lower working roller 156, 157.

The control unit 75 comprises a control device 170, a data storage medium 175 and an interface 180. The data storage medium 175 has a data connection to the control device 170 by means of a first data connection 185. The interface 180 likewise has a data connection to the control device 170 by means of a second data connection 190.

The data storage medium 175 stores a predefined first target temperature, a predefined second target temperature and a predefined third target temperature. The data storage medium 175 also stores a method for producing a dual-phase steel strip 245, on the basis of which the control device 170 controls the components of the combined casting and rolling plant 10.

The interface 180 has a data connection to the intermediate heater 45 by means of a third data connection 195. A fourth data connection 200 provides a data connection of the finish-rolling train 55 to the interface 180. A fifth data connection 205 connects the cooling section 65 to the interface 180. The temperature measuring device 80, 85 is connected to the interface 180 via an assigned sixth and seventh data connection 210, 215, respectively. The measuring section 60 likewise has a data connection to the interface 180 by means of an eighth data connection 225. In addition, further data connections (not illustrated in FIG. 1) to the comprehensive components of the combined casting and rolling plant 10 may additionally be provided, such that it is possible to exchange information between the various components of the combined casting and rolling plant 10 and the control unit 75. The third to eighth data connections 195, 200, 205, 210, 215, 225 may, for example, be part of an industrial network.

The first temperature measuring device 80 is downstream of the intermediate heating means 45 and preferably upstream of the descaler 50 based on the conveying direction of the prerolled strip 125. The second temperature measuring device 85 is arranged between the first stand group 135 and the second stand group 140. In particular, the second temperature measuring device 85 is upstream of the intermediate cooler 160 based on the conveying direction of the finish-rolled strip 165.

Figure 2:
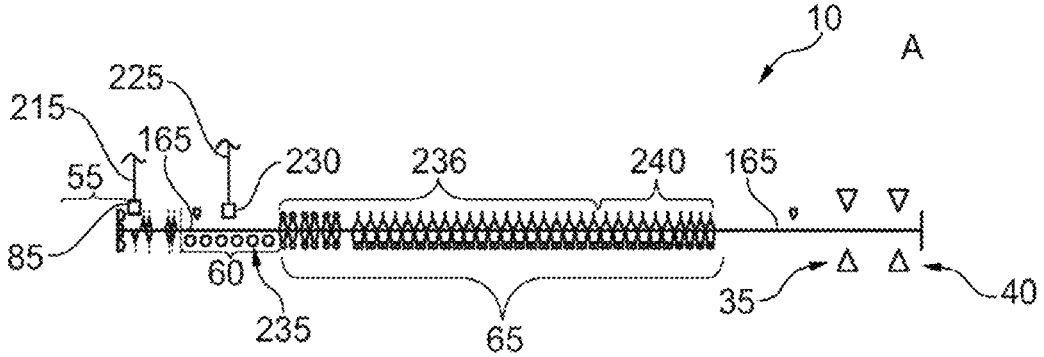
FIG. 2 shows a detail A, marked in FIG. 1, of the combined casting and rolling plant.

FIG. 2 shows a symbolic representation of a detail A, marked in FIG. 1, of the combined casting and rolling plant 10.

The measuring section 60 is arranged between the cooling section 65 and the finish-rolling train 55. The measuring section 60 has a sensor device 230 and a roller conveyor 235. The roller conveyor 235 is designed to transport the finish-rolled strip 165 coming from the finish-rolling train 55 between the finish-rolling train 55 and the cooling section 65.

The cooling section 65 has a first cooling-section group 236 and a second cooling-section group 240, wherein the first cooling-section group 236 follows directly on from the measuring section 60 and thus is downstream of the measuring section 60 in the conveying direction based on the conveying direction of the finish-rolled strip 165. The second cooling-section group 240 follows directly on from the first cooling-section group 236 on a side further away from the measuring section 60 and is downstream of the first cooling-section group 236 based on the conveying direction of the finish-rolled strip 165.

By way of example, the third and the fourth separating device 35, 40 follow on from the cooling section 65, wherein the third and/or the fourth separating device is in the form, for example, of drum shears or pendulum shears. By way of example, the coiling device 70 is downstream of the third and the fourth separating device 35, 40 in the conveying direction based on the finish-rolled strip 165.

Figure 3:
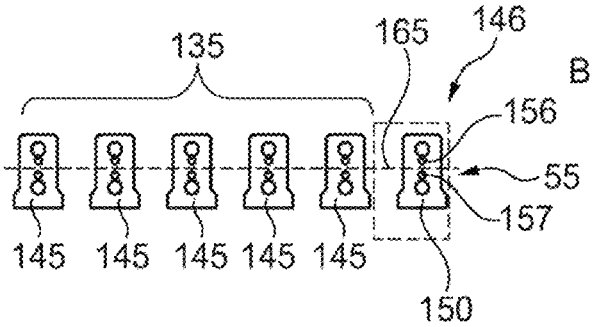
FIG. 3 shows the finish-rolling train during normal operation and in the non-converted state.

FIG. 3 shows the finish-rolling train 55 during normal operation and in the non-converted, regular state. FIG. 4 shows the finish-rolling train 55 shown in FIG. 1 in the converted state.

Before the method described below is performed, the second finish-rolling stand 150 of the second stand group 140 is converted to the configuration as stand cooler 155 in a preparation step.

The preparation step may to this end comprise removing the working rollers 156, 157 from the second finishing mill stand 150 (cf. FIG. 3) by opening the changeover device and replacing them with one or more cooling beams 158. Moreover, the cooling beam 158 may be aligned such that it is angled directly in the direction of a passage through which the finish-rolled strip 165 is conducted. In the closed state of the changeover device, the cooling beams 158 are secured in the stand cooler 155.

It is possible here, for example, for the stand cooler 155 to have two cooling beams 158 arranged on the top side and two cooling beams 158 arranged on the bottom side relative to the finish-rolled strip 165. It is pointed out that this configuration is an illustrative configuration of the second stand group 140. It will be appreciated that it would also be conceivable to design the second stand group 140 differently. It is thus possible, for example, for the intermediate cooler 160 to be omitted. A different arrangement of the intermediate cooler 160 would also be conceivable. The arrangement and/or number of cooling beams 158 is also illustrative. For instance, in one development, the number of cooling beams 158 may be increased or reduced. It is also conceivable for the cooling beams 158 to be arranged only on the top side or bottom side of the finish-rolled strip 165.

In this embodiment, the upper and/or lower working rollers 156, 157 are dismounted in order to provide sufficient structural space for the cooling beams 158 in the second finish-rolling stand 150 that has been converted to the stand cooler 155. In one development, it would also be possible for just the upper or lower working roller 156, 157 to be removed.

As a result of the preparation step, the structure of the combined casting and rolling plant 10 shown in FIGS. 2 and 3 no longer corresponds to the conventional structure of the first finish-rolling stand 145, but deviates from its structure and is illustrated in FIG. 4. The conversion means that the combined casting and rolling plant 10 is particularly suitable for performing the method described below.

Figure 5:
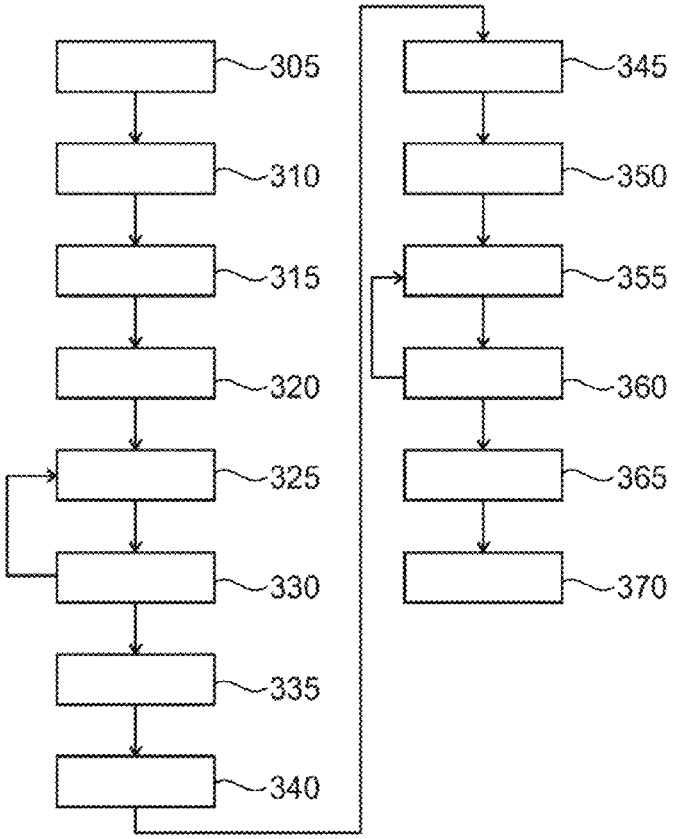
FIG. 5 shows a flow diagram of a method for operating the combined casting and rolling plant shown in FIG. 1, after the preparation step has been performed.
Figure 6:
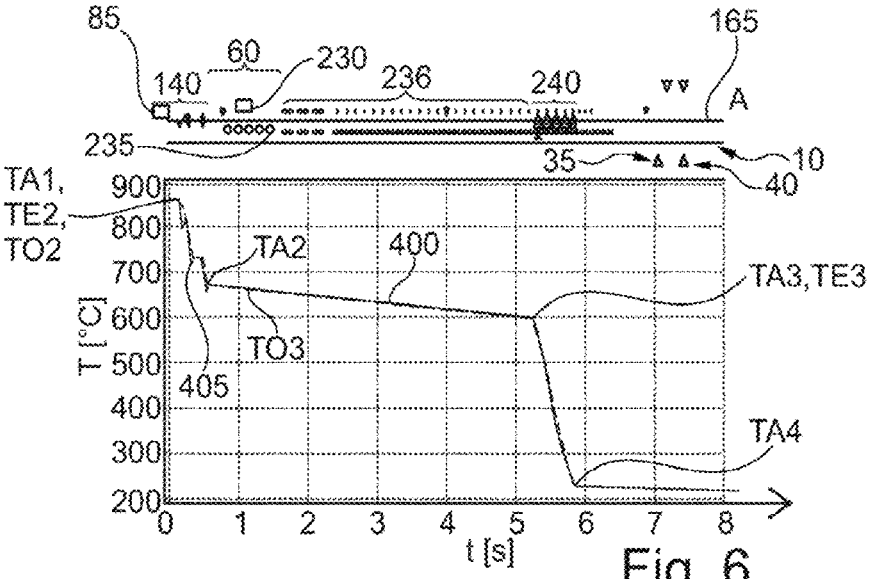
FIG. 6 shows a diagram of a temperature of the finish-rolled strip plotted over time as it passes through the finish-rolling train, the measuring section and the cooling section and the third and the fourth separating device.

FIG. 5 shows a flow diagram of a method for operating the combined casting and rolling plant 10 shown in FIG. 1, after the preparation step described in FIG. 4 has been performed. FIG. 6 shows a diagram of a temperature T of the finish-rolled strip 165 plotted over time as it passes through the finish-rolling train 55, the measuring section 60 and the cooling section 65 and the third and the fourth separating device 35, 40. FIG. 7 schematically shows the detail A marked in FIG. 1 of the combined casting and rolling plant 10 while the method described in FIG. 5 is being performed.

In FIG. 6, a first graph 400 and a second graph 405 are plotted. The first graph 400 shows a temperature curve for a core of the finish-rolled strip 165 and the second graph 405 shows a curve for a surface temperature of the finish-rolled strip 165 when the method elucidated in FIG. 5 is being performed.

During operation of the combined casting and rolling plant 10, in a first method step 305, the mold 105 (illustrated in FIG. 1) of the continuous casting machine 15 is closed with a dummy bar head (not illustrated in FIG. 1) and sealed by additional sealing means. The distributor 100 of the continuous casting machine 15 is filled with the molten metal 110 by means of the ladle 95. In order to begin continuous casting, a stopper is removed from a casting tube of the continuous casting machine 15. The molten metal 110 preferably has a chemical composition in percent by weight of C 0.03-0.30%; Mn 1.0-2.0%; Si 0.1-1.0%; sum total of the alloy constituents Cr and Mo: 0.2-1.0%; sum total of the alloy constituents Nb and Ti: 0.02-0.1%; P 0-0.02; remainder Fe and unavoidable impurities. The molten metal 110 may also have a different chemical composition.

The temperatures and method steps specified below refer to the chemical composition of the steel preferred in the embodiment in order to produce the finish-rolled strip 165 in the form of a dual-phase steel strip 245 by means of the combined casting and rolling plant 10.

When the continuous casting begins, the molten metal 110 flows around the dummy bar head in the mold 105 and solidifies on the dummy bar head. The dummy bar head is slowly drawn out of the mold 105 of the continuous casting machine 15 in the direction of the prerolling train 20. Downstream of the dummy bar head in the conveying direction, the molten metal 110 in the mold 105 cools at its contact surfaces with the mold 105 and forms a shell of the thin-slab strand 115. The shell surrounds a still-liquid core and retains the liquid core. At the mold outlet, the thin-slab strand 115 may have a thickness of 100 mm to 150 mm, for example.

In the continuous casting machine 15, the thin-slab strand 115 is deflected and further cooled on the way to the prerolling train 20, with the result that the thin-slab strand 115 solidifies from the outside in. In this embodiment, by way of example the continuous casting machine 15 is in the form of a bow-type continuous casting machine as elucidated above, and therefore, as a result of deflection of the thin-slab strand 115 by substantially 90° from the vertical, the thin-slab strand 115 is fed to the prerolling train 20 in a substantially horizontal orientation.

In a second method step 310, the thin-slab strand 115, as already elucidated above, is rolled by the prerolling stands 120 in the prerolling train 20 to afford the prerolled strip 125.

In the case of the aforementioned chemical composition, a core temperature of the core of the thin-slab strand 115 as it enters the prerolling train 20 is about 1300° C. to 1450° C. Upon each hot-rolling step in the prerolling train 20, the core temperature of the core is reduced, with the result that the prerolled strip 125 has a core temperature of about 980° C. to 1150° C. at the outlet.

In a third method step 315, the prerolled strip 125 is passed through the first and the second separating device 25, 30 without separating off the prerolled strip 125. Therefore, passage only occurs through the first and the second separating device 25, 30. The prerolled strip 125 is cooled further by convection, and a protective cover can reduce the cooling during transport to the intermediate heater 45.

In a fourth method step 320, the control device 170 activates the intermediate heater 45 via the third data connection 195, with the result that the intermediate heater 45, which is in the form for example of an induction furnace, increases the core temperature of the prerolled strip 125 as it enters the intermediate heater 45 from about 870° C. to 980° C. to about 1050° C. to 1100° C.

In a fifth method step 325, the first temperature measuring device 80, in the form for example of a first pyrometer, ascertains a first surface temperature of the prerolled strip 125 conducted out of the intermediate heater 45. The first temperature measuring device 80 provides a first item of information about the first surface temperature of the prerolled strip 125 between the intermediate heater 45 and the descaler 50 via the sixth data connection 210 of the interface 180, which provides the first item of information to the control device 170.

In a sixth method step 330, the control device 170 controls a heating output of the intermediate heater 45 in such a way that the ascertained first surface temperature of the prerolled strip 125 between the intermediate heater 45 and the descaler 50 corresponds substantially to the first target temperature. The control device 170 can repeat the fifth and the sixth method step 325, 330 regularly in a loop at a predefined time interval.

In a seventh method step 335, the control device 170 activates the descaler 50 (if present). The descaler 50 descales the prerolled strip 125. This cools the prerolled strip 125, for example by 80° C. to 100° C., based on the core of the prerolled strip 125.

In an eighth method step 340, the prerolled strip 125 is transported with a first inlet temperature TE1 to the first stand group 135 of the finish-rolling train 55. The first inlet temperature TE1 based on the core of the prerolled strip 125, with which the prerolled strip 125 enters the first stand group 135 downstream of the descaler 50, may be between 850° C. and 1060° C., in particular between 920° C. and 980° C.

In a ninth method step 345, the prerolled strip 125 is finish-rolled, for example by means of five first finish-rolling stands 145, to afford the finish-rolled strip 165. The five first finish-rolling stands 145 have the advantage that rolling forces acting on the rollers at any rolling pass of the respective first finish-rolling stand 145 is reduced, and this makes it possible to keep wear of the rollers of the first finish-rolling train 145 low. The finish-rolled strip 165 leaves the first stand group 135 with a thickness of 0.7 mm to 2.0 mm, in particular 0.7 mm to 1.3 mm. Consequently, the first stand group 135 reduces a thickness of the prerolled strip 125 as it enters the first stand group 135 of 6 mm to 25 mm, in particular 8 mm to 10 mm, to a thickness of 0.7 mm to 2.0 mm. At each first finish-rolling stand 145 in the first stand group 135, the prerolled strip 125 to be rolled to afford the finish-rolled strip 165 is cooled by about 50° C.

A first outlet temperature TA1 of the finish-rolled strip 165 after passing through the first stand group 135 is preferably 830° C. to 950° C., in particular 850° C. to 920° C. The first outlet temperature TA1 is based on the core of the finish-rolled strip 165.

In a tenth method step 350, the finish-rolled strip 165 is transported with the first outlet temperature TA1 further in the direction of the second stand group 140. Because the second stand group 140 follows on directly from the first stand group 135, a period of time from leaving the first stand group 135 to entering the second stand group 140 is minimized. In particular, by virtue of the direct arrangement of the second stand group 140 downstream of the first stand group 135, the period of time may be only 0.2 second to 1 second. In particular, the intermediate cooler 160 that follows on from the first stand group 135 may follow on from the first stand group 135 spatially at a distance of a few meters (<10 m) down to about 0.5 m. By virtue of the spatially small distance between the first stand group 135 and the second stand group 140, the first outlet temperature TA1 corresponds substantially to a second inlet temperature TE2, with which the finish-rolled strip 165 enters the second stand group 140.

Moreover, in the tenth method step 350, a second surface temperature TO2 of the finish-rolled strip 165 coming from the first stand group 135 is ascertained by means of the second temperature measuring device 85, which is in the form for example of a second pyrometer. The second temperature measuring device 85 provides a second item of information, which correlates with the first outlet temperature TA1, via the seventh data connection 215 and the interface 180 of the control device 170. The control device 170 can also take into account the second surface temperature TO2 in the control of the intermediate heater 45.

The second surface temperature TO2 correlates, as already explained, with the first outlet temperature TA1, the second surface temperature TO2 deviating in terms of value from the first outlet temperature TA1. This is in particular because the second surface temperature TO2 relates to the surface of the finish-rolled strip 165 and the first outlet temperature TA1 relates to the core of the finish-rolled strip 165. Since the finish-rolled strip 165 is only 0.7 mm to 2.0 mm thick, however, a temperature difference between the first outlet temperature TA1 and the second surface temperature is small (<10° C.).

In this embodiment, the regulation of the intermediate heater 45 by the control device 170 is carried out by way of example such that the second surface temperature TO2 substantially corresponds to the second target temperature in the regulation of the intermediate heater 45. However, the second temperature measuring means 85 and/or the tenth process step 350 may also be eschewed.

In an eleventh method step 355, the control device 170 activates the intermediate cooler 160 and the stand cooler 155 of the second stand group 140 of the finish-rolling train 55 via the fourth data connection 200. The finish-rolled strip 165 is also guided through the second stand group 140 while maintaining its thickness. There is no further rolling of the finish-rolled strip 165 in which the thickness of the finish-rolled strip 165 is reduced. If one of the working rollers 156, 157 has remained in the stand cooler 155, it can be used to support and/or to transport the finish-rolled strip 165.

The intermediate cooler 160 and the stand cooler 155 spray a cooling medium, for example water, if appropriate with an additive, onto the hot finish-rolled strip 165. As a result, the finish-rolled strip 165 is force cooled in the second stand group 140.

A volume flow of the cooling medium is preferably selected such that, within the second stand group 140, the finish-rolled strip 165 is cooled from the second inlet temperature TE2, which substantially corresponds to the first outlet temperature TA1, to a second outlet temperature TA2 of in particular 600° C. to 750° C., preferably 650° C. to 720° C., within a first time interval of 0.2 seconds to 1 second inclusive. The second outlet temperature TA2 is based on the core of the finish-rolled strip 165 and is lower than a ferrite precipitation temperature (also referred to as Ar3 temperature). It is particularly advantageous in this respect if the conveyed amount of the cooling medium is selected such that a cooling output of the second stand group 140 ensures a first cooling rate of the core of the finish-rolled strip 165 of at least 100 K/s to 2000 K/s, in particular 200 K/s to 1000 K/s. The cooling in the core of the finish-rolled strip 165 in the second stand group 140 is effected preferably continuously via the second stand group 140.

In this embodiment, the first cooling rate is ensured in that a volume flow of about 100 $m^3$/h to 350 $m^3$/h of the cooling medium is sprayed onto the finish-rolled strip 165 with a pressure of 2 bar to 4 bar, preferably by means of the arrangement of multiple cooling beams 158, preferably precooling beams of the stand cooler 155. This ensures that, within the short traversal time of the finished strip 165, for example with a velocity of 4 to 10 m/s through the second stand group 140, the core of the finish-rolled strip 165 is cooled from the second inlet temperature TE2 of, for example, 870° C. to 910° C. to the second outlet temperature TA2.

Advantageously, each stand cooler 155 and the intermediate cooler 160 may be designed such that a control valve controllable by the control device 170 is provided for each cooling beam 158 in order to actuate them separately from one another preferably with continuous variability and separately from the respective other cooling beams 158 of the intermediate cooler 160 or of the stand cooler 155. This allows continuously variable regulation between 0% and 100% of the volume flow of the cooling medium by the control device 170 for each cooling beam 158 of the stand cooler 155 and/or of the intermediate cooler 160.

The rapid and very early cooling of the finish-rolled strip 165 directly downstream of the first stand group 135 makes it possible to ensure that the maximum possible first cooling rate is commenced with the high second inlet temperature TE2.

In a twelfth method step 360, the finish-rolled strip 165 is transported into the measuring section 60 with the second outlet temperature TA2. At the outlet, a microstructure of the finish-rolled strip 165 is predominately, in particular greater than 80 percent by weight, austenitic. In the twelfth method step 360, the finish-rolled strip 165 is also transported within the measuring section 60 by means of the roller conveyor 235.

Furthermore, the sensor device 230, which is in the form for example of a third pyrometer, ascertains a third surface temperature TO3 that correlates with the second outlet temperature TA2 after the finish-rolled strip 165 has left the second stand group 140 and entered the measuring section 60. The sensor device 230 provides a third item of information about the third surface temperature TO3 via the eighth data connection 225 of the interface 180 and via the interface 180 of the control device 170.

The control device 170 can also take into account the item of information about the third surface temperature TO3 in the regulation of the volume flow of the cooling medium in the second stand group 140 in the eleventh process step 355. In particular, the control device 170 can regulate the volume flow of the cooling medium, which is sprayed onto the finish-rolled strip 165 by the second stand group 140, in such a way that the third surface temperature TO3 substantially corresponds to the third target temperature. When regulating the volume flow, the control device 170 may also additionally take into account the second surface temperature TO2, in order to ensure a uniform first cooling rate in the second stand group 140. In the process, the control device 170 can repeat the eleventh and twelfth method steps 355, 360 regularly in a loop at a predefined time interval.

In a thirteenth method step 365, the finish-rolled strip 165 is transported in the first cooling-section group 236 in the warm, partially cooled state.

In the thirteenth process step 365, the control device 170 deactivates the first cooling-section group 236 or keeps it in the deactivated state, with the result that, when the finish-rolled strip 165 passes through the first cooling-section group 236, no further cooling medium is applied to the finish-rolled strip 165 for further forced cooling of the finish-rolled strip 165.

In the twelfth and the thirteenth method step, the finish-rolled strip 165 is cooled down from the second outlet temperature TA2 via the measuring section 60 and the first cooling-section group 236 at a second cooling rate. The second cooling rate is markedly lower than the first cooling rate. The second cooling rate is, for example, 0 K/s to 20 K/s inclusive. The second cooling rate results primarily from convective cooling of the finish-rolled strip 165 in the first stand group 236 and on the roller conveyor 235. The result of the cooling below the ferrite initiation temperature in the eleventh method step 355 is that some of the austenitic microstructure is converted to ferrite during the transport, which happens within a second time interval of preferably 3 to 6 seconds, in particular 4 to 5 seconds, between the outlet of the second stand group 140 and the inlet of the second cooling-section group 240. This results in the formation of a mixed microstructure of austenite and ferrite in the finish-rolled strip 165, and therefore the finish-rolled strip 165 is in the form of a dual-phase steel strip 245 at the end of the second cooling-section group 240.

At the end of the first cooling-section group 236, in particular the composition of the material of the finish-rolled strip 165 is as follows (based on percent by weight): 50%-95% ferrite; the remainder is substantially austenite.

At the end of the first cooling-section group 236, the core of the finish-rolled strip 165 has a third outlet temperature TA3, which is lower than the second outlet temperature TA2. In particular, the third outlet temperature TA3 may be 580° C. to 650° C., in particular 590° C. to 630° C. The third outlet temperature TA3 corresponds to a third inlet temperature TE3, with which the finish-rolled strip 165 enters the second cooling-section group 240 and which is based on the core of the finish-rolled strip 165.

In a fourteenth method step 370, the control device 170 activates the second cooling-section group 240, if not already activated, via the fifth data connection 205.

In the second cooling-section group 240, the cooling train 65 cools the finish-rolled strip 165 down from the third inlet temperature TE3 to a fourth outlet temperature TA4 by means of the cooling medium. In the process, the cooling medium is sprayed onto the warm finish-rolled strip 165, which is entering with the third inlet temperature TE3/third outlet temperature TA3, in the second cooling-section group 240, with the result that the finish-rolled strip 165 is force cooled in the second cooling-section group 240. In particular, the fourth outlet temperature TA4 may be 150° C. to 250° C., preferably 190° C. to 230° C. In this respect, the finish-rolled strip 165 is cooled from the third inlet temperature TE3 to the fourth outlet temperature TA4 at a third cooling rate, in particular within a third time interval of less than 1 second, in particular within the third time interval of 0.2 seconds to 0.7 seconds. The third cooling rate may be in particular 100 K/s to 2000 K/s, in particular 200 K/s to 1000 K/s. The cooling in the core of the finish-rolled strip 165 is effected preferably continuously via the second cooling-section group 240.

In this embodiment, the third cooling rate is ensured such that preferably, for instance, a further volume flow of 100 $m^3$/h to 300 $m^3$/h of the cooling medium is applied to the finish-rolled strip 165 with a pressure of 2 bar to 4 bar. This ensures that, within the short third time interval of the finished strip 165 passing through the second cooling-section group 240, the core of the finish-rolled strip 165 is cooled from the third inlet temperature TE3 to the fourth outlet temperature TA4.

Each cooling beam 158 of the second cooling-section group 240 may be designed such that said beam is in each case provided with a control valve controllable by the control device 170, in order to actuate them separately from one another, preferably with continuous variability and separately from the respective other cooling beams 158 of the second cooling-section group 240. This allows continuously variable regulation between 0% and 100% of a volume flow of the cooling medium within the second cooling-section group 240 by the control device 170 for each of the cooling beams 158 of the second cooling-section group 240.

The rapid cooling of the finish-rolled strip 165 after transport, and the conversation of the austenite microstructure to martensite between the third inlet temperature TE3 and the fourth outlet temperature TA4, ensure formation of the dual-phase microstructure of martensite and ferrite. Consequently, the austenitic microstructure, which is present at the end of the first cooling-section group 236, is converted to martensite in the second cooling-section group 240 owing to the fast quenching at the third quenching rate. In the process, most, preferably all of, the austenitic microstructure proportion that is present is converted to martensite. The virtually complete conversion is therefore possible since the thin-wall configuration of the finish-rolled strip 165 at the third quenching rate makes it possible to quench both the core and regions close to the surface of the finish-rolled strip 165.

In a fifteenth method step 370, the finish-rolled strip 165, which has been cooled to the fourth outlet temperature TA4 by the second cooling-section group 240 and is in the form of a dual-phase steel strip 245, is guided through the third separating device 35 and the fourth separating device 40 toward the coiling device 70. In the coiling device 70, the finish-rolled and cooled dual-phase steel strip 245 is coiled up to afford a coil. Since the coiling device 70 is at a spacing from the cooling section 65 and the fourth outlet temperature TA4 is considerably greater than 100° C., excess cooling medium can run and be dried off of the finish-rolled strip 165 between the exit of the fully cooled dual-phase steel strip 245 and the coiling-up of the cooled dual-phase steel strip 245 in the coiling device 70 to afford the coil, with the result that the dual-phase steel strip 245 is preferably coiled up in the dry state.

After the coil has been coiled up, the control device 170 can activate the third separating device 35 or the fourth separating device 40, with the result that the dual-phase steel strip 245 conveyed continuously out of the cooling section 65 is separated from the coil and the fully coiled-up coil can be removed. The further cooled dual-phase steel strip 245 can be coiled up to afford a new coil. For this, multiple coiling devices 70 can be provided in the combined casting and rolling plant 10. In this embodiment, three coiling devices 70 are provided by way of example. As an alternative, it would also be conceivable, for example, for the combined casting and rolling plant 10 to have only two coiling devices 70.

The above-described combined casting and rolling plant 10 and the method described in FIG. 5 have the advantage that the finish-rolled strip 165 produced from the above-described chemical composition of the molten metal 110 has a dual-phase form and a predominantly ferritic and martensitic microstructure. In particular, the dual-phase steel strip 245 has the following chemical composition: C 0.03-0.30%; Mn 1.0-2.0%; Si 0.1-1.0%; sum total of the alloy constituents Cr and Mo: 0.2-1.0%; sum total of the alloy constituents Nb and Ti: 0.02-0.1%; P 0-0.02; remainder Fe and unavoidable impurities. In this context, at room temperature, the dual-phase steel strip 245 has the following microstructure (based on percent by weight): 50% to 95% inclusive of ferrite, 10% to 50% inclusive of martensite, less than or equal to 5% of residual austenite and/or bainite, and, if appropriate, a remainder. The ferrite proportion is preferably greater than the martensite proportion, the austenite proportion and, if appropriate, the bainite proportion. For instance, the dual-phase steel strip 245 can typically comprise about 90% of ferrite, 10% of martensite and the remainder austenite.

The above-described method and the above-described combined casting and rolling plant 10 thus make it possible to produce the dual-phase steel strip 245 with a particularly low thickness, in particular 0.7 to 2.0 mm, in particular 0.7 to 1.3 mm, in a continuous casting process. Even at a high speed, for example of 10 m/s, a holding time which corresponds to the second time interval, between the exit of the finish-rolled strip 165 from the second stand group 140 and entry into the second cooling-section group 240, of 3 to 6 seconds, in particular 4 to 5 seconds, is ensured. Since only the second cooling-section group 240 is activated and the first cooling-section group 236, which is directly upstream of the second cooling-section group 240 in the conveying direction of the finish-rolled strip 165, is deactivated, the measuring section 60 can similarly also be used to shorten the holding time in which the finish-rolled strip 165 is not actively cooled. As a result, the conversion of the predominantly austenitic microstructure to a dual-phase ferritic and austenitic microstructure with a sufficiently high austenitic microstructure proportion of 5% to 50% is ensured. This makes it possible to produce the thin finish-rolled strip 165 with the thickness of 0.7 to 2.0 mm specified above in the case of a spatially relatively short combined casting and rolling plant 10.

The above-described configuration of the combined casting and rolling plant 10 furthermore permits a high casting velocity of 0.08 to 1.5 m/s, in particular 0.1 m/s, at the specified thickness of the thin-slab strand 115 of 100 mm to 150 mm.

It should be noted that the combined casting and rolling plant 10 may also be configured in a different way than that described in the FIGS. In particular, it would also be possible for the combined casting and rolling plant 10 to have, for example, only three prerolling stands 120 and five second finish-rolling stands 150. In this configuration, the second finish-rolling train 150 that is last in the conveying direction would then be converted to the stand cooler 155. In this configuration, although the rolling forces on the individual prerolling stands and finish-rolling stands are greater than in the configuration shown in FIG. 1, this combined casting and rolling plant 10 is spatially shorter than the combined casting and rolling plant 10 shown in FIG. 1.

The dual-phase steel strip 245 produced by the combined casting and rolling plant 10 and the method described in FIG. 5 is suitable in particular for producing vehicle body panels and exhibits particularly good material properties owing to a dual-phase microstructure of ferrite and martensite. The dual-phase steel strip 245 is particularly tough and strong. Furthermore, the combined casting and rolling plant 10 has a particularly exact temperature regime, and this ensures high process reliability.

Since exclusively the stand cooler 155, or the second finish-rolling stand 150, is to be converted to the stand cooler 155, in order to perform the method described above in FIG. 5, it is possible, provided that it is not a dual-phase steel strip 245 that is to be produced, to operate the combined casting and rolling plant 10 conventionally in normal operation (cf. FIG. 2), it being the case in normal operation that the intermediate cooler 160 is deactivated and the cooling section 65 is activated preferably over its entire length. During normal operation, for example in order to produce a finish-rolled strip 165 having a thickness of >1.4 mm, the finish-rolled strip 165 is then rolled by all the finish-rolling stands 145, 150 and the finish-rolled strip 165 is cooled substantially in the cooling section 65 rather than in the second stand group 140 and the second cooling-section group 240.

LIST OF REFERENCE SIGNS

10 Combined casting-rolling plant
15 Continuous casting machine
20 Prerolling train
25 First separating device
30 Second separating device
35 Third separating device
40 Fourth separating device
45 Intermediate heater
50 Descaler
55 Finish-rolling train
60 Measuring section
65 Cooling section
70 Coiling device
75 Control unit
80 First temperature measuring device
85 Second temperature measuring device
95 Ladle
100 Distributor
105 Mold
110 Molten metal
115 Thin-slab strand
120 Prerolling stand
125 Prerolled strip
130 Discharging device
135 First stand group
140 Second stand group
145 First finish-rolling stand
150 Second finish-rolling stand
155 Stand cooler
156 Upper working roller
157 Lower working roller
158 Cooling beams
160 Intermediate cooler
165 Finish-rolled strip
170 Control device
175 Data storage medium
180 Interface
185 First data connection
190 Second data connection
195 Third data connection
200 Fourth data connection
205 Fifth data connection
210 Sixth data connection
215 Seventh data connection
225 Eighth data connection
230 Sensor device
235 Roller conveyor
236 First cooling-section group
240 Second cooling-section group
245 Dual-phase steel strip
305 First method step
310 Second method step
315 Third method step
320 Fourth method step
325 Fifth method step
330 Sixth method step
335 Seventh method step
340 Eighth method step
345 Ninth method step
350 Tenth method step
355 Eleventh method step
360 Twelfth method step
365 Thirteenth method step
370 Fourteenth method step
400 First graph
405 Second graph
TA1 First outlet temperature
TA2 Second outlet temperature
TA3 Third outlet temperature
TA4 Fourth outlet temperature
TE1 First inlet temperature
TE2 Second outlet temperature
TE3 Third outlet temperature
TO2 Second surface temperature
TO3 Third surface temperature

The invention claimed is:

1. A method for producing a dual-phase steel strip in a combined casting and rolling plant, wherein the combined casting and rolling plant comprises a finish-rolling train having a first stand group with at least one first finish-rolling stand and a second stand group with at least one stand cooler, and a cooling section having a first cooling-section group and a second cooling-section group, wherein a hot prerolled strip is fed to the first stand group of the finish-rolling train and finish-rolled by the first stand group of the finish-rolling train to afford a finish-rolled strip, wherein, directly after the finish-rolling of the finish-rolled strip, the finish-rolled strip is fed to the second stand group and, in the second stand group, the finish-rolled strip is force-cooled to an outlet temperature (TA2) while maintaining a thickness of the finish-rolled strip, in such a way that the finish-rolled strip has a predominantly austenitic microstructure when it leaves the second stand group, wherein the finish-rolled strip, which has been cooled to the outlet temperature (TA2), is fed to the first cooling-section group, wherein forced cooling of the finish-rolled strip in the first cooling-section group is deactivated and the finish-rolled strip is transported from the first cooling-section group to the second cooling-section group, wherein, during the transport, a ferritic and austenitic microstructure predominantly forms in the finish-rolled strip, wherein, in the second cooling-section group, the finish-rolled strip is force-cooled to an outlet temperature (TA4) in such a way that, after leaving the second cooling-section group, the finish-rolled strip has a dual-phase microstructure of martensite and ferrite.

2. The method as claimed in claim 1, wherein, in the second stand group, the finish-rolled strip is force-cooled in such a way that a first cooling rate of a core of the finish-rolled strip is established, wherein, during the transport of the finished strip between the second stand group of the finish-rolling train and the second cooling group, a second cooling rate of the core of the finish-rolled strip is established, wherein, in the second cooling-section group, the finish-rolled strip is force-cooled in such a way that a third cooling rate of the core of the finish-rolled strip is established, wherein the second cooling rate is lower than the first cooling rate and/or the third cooling rate, wherein the first cooling rate and/or the third cooling rate of the core of the finish-rolled strip is 100 K/s to 2000 K/s inclusive, wherein the third cooling rate of the core of the finish-rolled strip is 0 K/s to 20 K/s inclusive.

3. The method as claimed in claim 1, wherein a third surface temperature, with which the finish-rolled strip leaves the second stand group, is ascertained between the second stand group and the cooling section, wherein the forced cooling in the second stand group is controlled depending on the third surface temperature and a third target temperature (TS3) in such a way that the third surface temperature corresponds to the third target temperature (TS3), wherein the third target temperature (TS3) is lower than the austenite-ferrite conversion temperature (Ar3 temperature).

4. The method as claimed in claim 3, wherein a second surface temperature, with which the finish-rolled strip leaves the first stand group, is ascertained, wherein the second surface temperature is also taken into account in the control of the forced cooling of the finish-rolled strip in the second stand group.

5. The method as claimed in claim 1, wherein a core of the finish-rolled strip is transported to the second stand group of the finish-rolling train with an outlet temperature (TA1) in the range of 830° C. to 950° C., wherein, when the finish-rolled strip leaves the second stand group, the core of the finish-rolled strip has the outlet temperature (TA2) in the range 600° C. to 750° C.

6. The method as claimed in claim 5, wherein the core of the finish-rolled strip is cooled, from the outlet temperature (TA1) to the outlet temperature (TA2) within a first time interval of 0.2 seconds to 1 second.

7. The method as claimed in claim 1, wherein the finish-rolled strip is transported from the second stand group of the finish-rolling train to the second cooling-section group via the first cooling-section group within a second time interval of 3 seconds to 6 seconds.

8. The method as claimed in claim 1, wherein the core of the finish-rolled strip is transported to the second cooling-section group of the cooling section with an outlet temperature (TA3) in the range 580° C. to 650° C., wherein, when the finish-rolled strip leaves the second cooling-section group, the core of the finish-rolled strip has the outlet temperature (TA4) in the range 150° C. to 250° C.

9. The method as claimed in claim 8, wherein the core of the finish-rolled strip is cooled from the outlet temperature (TA3) to the outlet temperature (TA4) within a third time interval of 0.2 seconds to 1 second.

10. The method as claimed in claim 1, wherein a thickness of the prerolled strip upon entry into the first stand group is 6 mm to 25 mm, wherein the first stand group reduces the thickness of the prerolled strip to that of the finish-rolled strip of 0.7 mm to 2.0 mm.

11. The method as claimed in claim 1, wherein the finish-rolled strip has a chemical composition in percent by weight of C 0.03 to 0.30%; Mn 1.0 to 2.0%; Si 0.1 to 1.0%; sum total of (Cr+Mo): 0.2 to 1.0%; sum total of (Nb+Ti): 0.02 to 0.1%; P 0 to 0.02; remainder Fe and unavoidable impurities.

12. The method as claimed in claim 1, wherein the second stand group has a second finish-rolling stand, wherein the second finish-rolling stand, in a preparation step prior to casting of a molten metal, is converted to the stand cooler by removing at least one working roller of the second finish-rolling stand and introducing at least one cooling beam into the second finish-rolling stand.

13. The method as claimed in claim 1, wherein a prerolled strip is fed to the finish-rolling train and the first stand group is designed to finish-roll the prerolled strip to afford the finish-rolled strip, wherein, based on a conveying direction of the finish-rolled strip, the second stand group is downstream of the first stand group and has at least one stand cooler, wherein the second stand group is designed to force cool the finish-rolled strip to the outlet temperature (TA2) while maintaining a thickness of the finish-rolled strip, wherein, based on the conveying direction of the finish-rolled strip, the first cooling-section group is downstream of the second stand group, wherein forced cooling of the finish-rolled strip in the first cooling-section group is deactivated, wherein, based on the conveying direction of the finish-rolled strip, the second cooling-section group is downstream of the first cooling-section group, wherein the second cooling-section group is designed to force-cool the finish-rolled strip to the outlet temperature (TA4).

14. The method as claimed in claim 13, wherein a measuring section is arranged between the cooling section and the second stand group, wherein the measuring section has at least one sensor device, which is designed at least to detect a surface temperature of the finish-rolled strip, wherein the measuring section has a roller conveyor, which is designed to transport the finish-rolled strip from the second stand group to the first cooling-section group.

* * * * *